US010767447B2

(12) United States Patent
Kartha et al.

(10) Patent No.: US 10,767,447 B2
(45) Date of Patent: Sep. 8, 2020

(54) DOWNHOLE RADIAL CLEANOUT TOOL

(71) Applicant: Halliburton Energy Services, Inc., Houston, TX (US)

(72) Inventors: Nikhil Manmadhan Kartha, Jalan Sendudok (SG); Mark S. Holly, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 143 days.

(21) Appl. No.: 15/776,026

(22) PCT Filed: Feb. 15, 2016

(86) PCT No.: PCT/US2016/017969
§ 371 (c)(1),
(2) Date: May 14, 2018

(87) PCT Pub. No.: WO2017/142504
PCT Pub. Date: Aug. 24, 2017

(65) Prior Publication Data
US 2018/0328146 A1 Nov. 15, 2018

(51) Int. Cl.
*E21B 37/00* (2006.01)
*B08B 9/047* (2006.01)
(Continued)

(52) U.S. Cl.
CPC ..... *E21B 37/00* (2013.01); *B08B 9/0433* (2013.01); *E21B 41/0078* (2013.01)

(58) Field of Classification Search
CPC ..... E21B 41/0078; E21B 21/02; E21B 21/00; E21B 37/00; E21B 37/02; E21B 37/08; B08B 9/0433; B08B 9/045; B08B 9/047
See application file for complete search history.

(56) References Cited

U.S. PATENT DOCUMENTS 6,613,154 B1 * 9/2003 Lester ..... B08B 9/045 134/8
9,366,113 B2 * 6/2016 Etschel ..... E21B 37/08
(Continued)

FOREIGN PATENT DOCUMENTS

AU 2010201076 A1 10/2010
AU 2010245723 B2 9/2014
(Continued)

OTHER PUBLICATIONS

International Search Report and Written Opinion dated Feb. 15, 2016; International PCT Application No. PCT/US2016/017969.

*Primary Examiner* — Kenneth L Thompson
(74) *Attorney, Agent, or Firm* — McGuireWoods LLP

(57) ABSTRACT

A downhole cleanout tool includes a tool housing have a fluid inlet and a fluid outlet, and a filter between the inlet and the outlet. The tool includes a pump that is fluidly coupled to at least the fluid inlet to motivate fluid across the filter. The tool also includes a rotatable housing having a nozzle that is fluidly coupled to the pump outlet. The rotatable housing may rotate about a longitudinal axis of the rotatable housing, and the filter and pump may be disposed within the rotatable housing. Each nozzle may include a nozzle outlet oriented at an angle (a) from a radial axis extending from the longitudinal axis of the rotatable housing to a location where the nozzle outlet intersects the periphery of the rotatable housing such that motivation of fluid through the nozzle results in rotation of the rotatable housing.

20 Claims, 6 Drawing Sheets

(51) Int. Cl.
*B08B 9/043* (2006.01)
*E21B 41/00* (2006.01)

(56) References Cited

U.S. PATENT DOCUMENTS

| | | | | |
|---|---|---|---|---|
| 9,512,591 | B2 * | 12/2016 | Spreitzer | E02D 5/46 |
| 2002/0104649 | A1 * | 8/2002 | Allen | B08B 9/0436 166/173 |
| 2009/0173501 | A1 | 7/2009 | Kotsonis et al. | |
| 2011/0220151 | A1 | 9/2011 | Swinford | |
| 2012/0255724 | A1 | 10/2012 | Hallundbaek et al. | |
| 2014/0053874 | A1 | 2/2014 | MacKenzie et al. | |
| 2014/0216719 | A1 | 8/2014 | Xu et al. | |
| 2014/0374157 | A1 | 12/2014 | O'Neal et al. | |
| 2015/0308232 | A1 * | 10/2015 | Hallundbaek | E21B 23/03 166/312 |

FOREIGN PATENT DOCUMENTS

| | | | |
|---|---|---|---|
| CA | 2787145 | A1 | 7/2011 |
| GB | 2454884 | B | 11/2011 |
| WO | 2014207084 | A1 | 12/2014 |
| WO | 2015142184 | A1 | 9/2015 |

* cited by examiner

DOWNHOLE RADIAL CLEANOUT TOOL

FIELD

The present disclosure relates generally to a downhole tool for cleaning the interior of a wellbore.

BACKGROUND

Hydrocarbon producing wells may simultaneously produce water, which in turn may result in the development of inorganic scales being deposited on perforations, casing, production tubulars, and other downhole equipment. If left unattended, the scaling may adversely impact well performance.

A number of technologies exist for removing scaling without damaging the wellbore, tubing, or reservoir. For example, the scaling may be removed mechanically or dissolved chemically. In tubing, it may be feasible to simply pull the tubing from the wellbore to mill out scale deposit. Where scaling is in the wellbore, such an approach may not be feasible. Where milling is not practicable, other types of cleaning systems may be deployed.

BRIEF DESCRIPTION OF THE DRAWINGS

Illustrative embodiments of the present disclosure are described in detail below with reference to the attached drawing figures, which are incorporated by reference herein, and wherein.

Figure 1A:
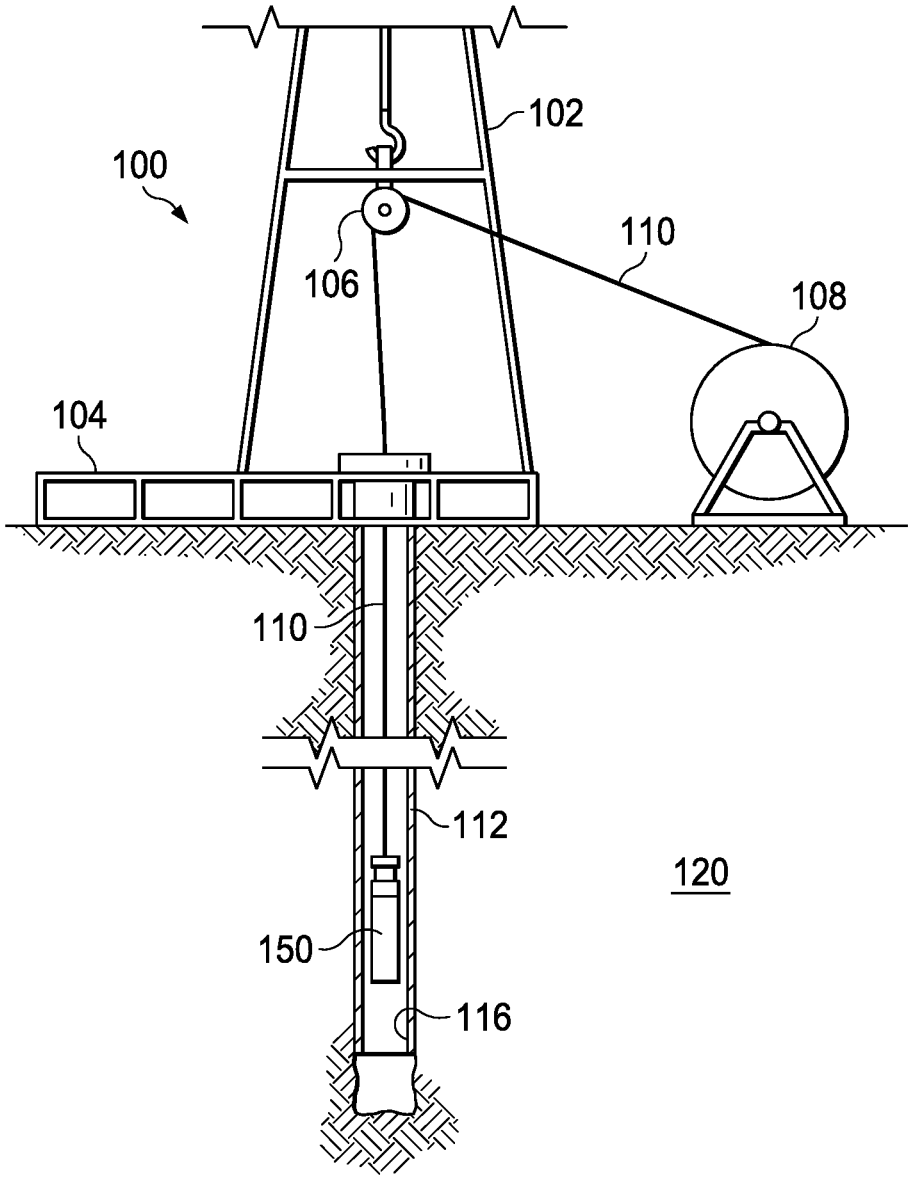
FIG. 1A is a schematic, side view of a cleanout tool deployed within a wellbore of a subterranean well.

The illustrated figures are only exemplary and are not intended to assert or imply any limitation with regard to the environment, architecture, design, or process in which different embodiments may be implemented.

DETAILED DESCRIPTION

The present disclosure relates to a downhole cleanout tool having a tool housing having a fluid inlet and a fluid outlet, and a filter disposed between the fluid inlet and the fluid outlet. The tool also includes a pump having a pump inlet and a pump outlet, the pump being fluidly coupled to at least the fluid inlet to motivate fluid across the filter. In addition, the tool includes a rotatable housing having at least one nozzle disposed therein, the nozzle being fluidly coupled to the pump outlet. In some embodiments, the rotatable housing includes a generally cylindrical housing operable to rotate about a longitudinal axis of the rotatable housing. The filter and pump may be positioned within or outside of the rotatable housing. The rotatable housing may be coupled to a power source and a supporting cable via a rotatable joint, such as a swivel joint, and including a slip ring.

In some embodiments, each nozzle of the downhole cleanout tool has a nozzle outlet that is oriented at an angle ($\alpha$) from a radial axis extending from the longitudinal axis of the rotatable housing to a location where the nozzle outlet intersects the periphery of the rotatable housing. This orientation allows for spray from the nozzle to induce a rotational force on the housing to induce rotation so that, as the housing rotates, nozzle spray impinges about the full internal circumference of a cross-section of a wellbore in which the nozzle is placed. In some embodiments, the rotation of the housing may be independently driven by an on-board motor.

In some embodiments, the filter of the tool is a canister filter having a filter inlet fluidly coupled to the fluid inlet, a generally cylindrical body forming a cylindrical cavity, and a plurality of apertures disposed about the circumference of the cylindrical body. The apertures are fluidly coupled to an annulus between an external surface of the canister filter and an internal surface of the rotatable housing. The annulus may be fluidly coupled to the pump inlet to allow for fluid to be drawn through the filter toward the pump inlet upon operation of the pump.

In some embodiments, the rotatable housing is coupled to a downhole end of the filter, and the rotatable housing is coupled to a spindle extending from the rotatable housing through the cylindrical cavity of the filter. In such embodiments, the spindle may comprise an auger. The spindle and auger may be operable to rotate relative to the generally cylindrical body of the filter when fluid is circulated through the nozzle, thereby allowing the auger to consolidate particulate gathered in the filter at a first end of the filter cavity. In some embodiments, cleaning of the wellbore may be accomplished solely by the nozzle spray that is impinged upon the wellbore wall. In other embodiments, cleaning may be augmented by scrubbers or brushes that extend from an external surface of the rotatable housing.

Figure 1B:
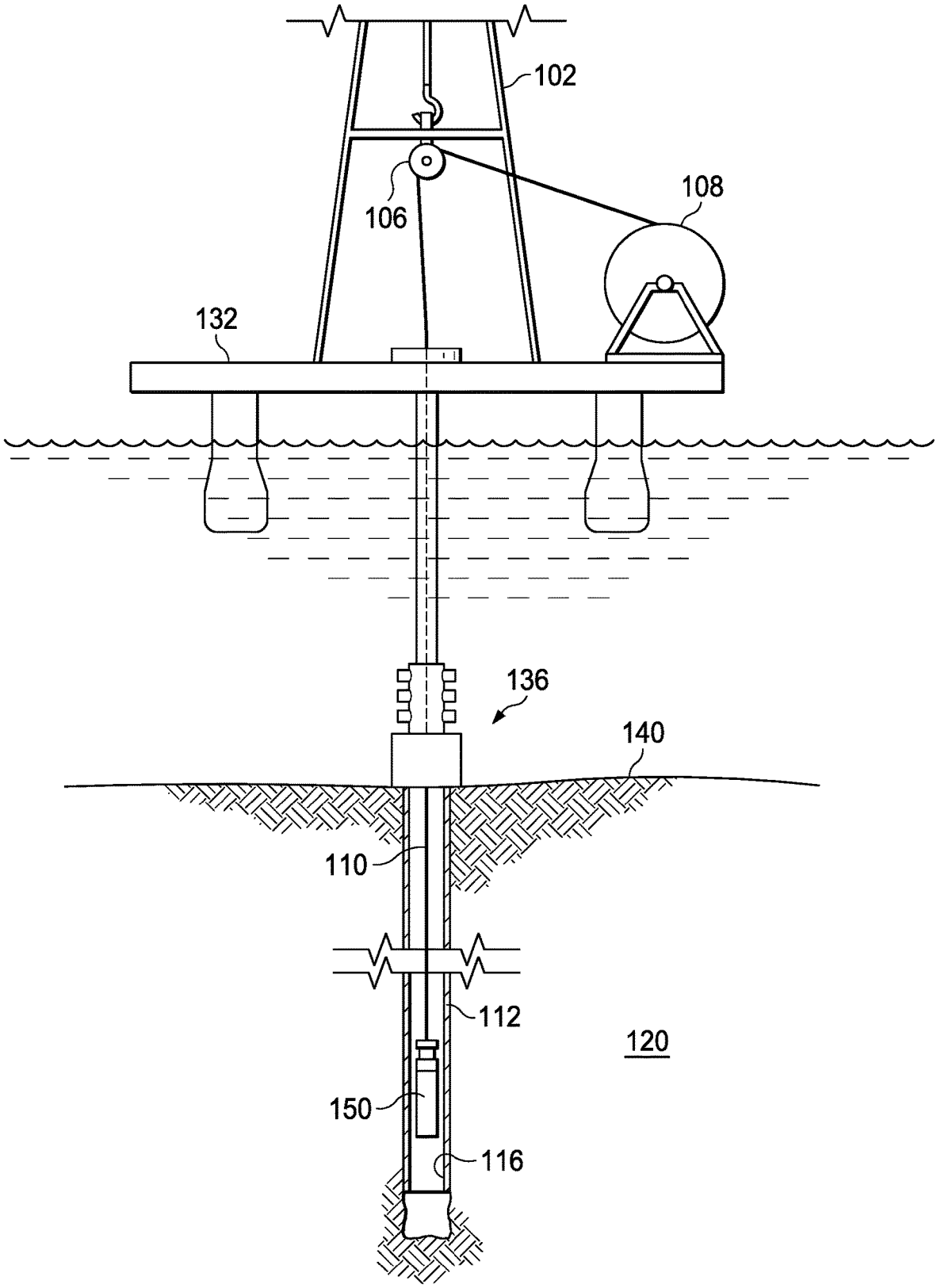
FIG. 1B is a schematic, side view of a cleanout tool deployed within a wellbore of a sub-sea well.

Turning now to the figures, FIG. 1A shows a wireline or slickline cleanout system 100 that includes a wireline or slickline-deployed cleanout tool 150 deployed to remove scaling in a wellbore 112 that extends into a subterranean formation 120. The wellbore may have a casing 116, as shown in FIG. 1A. In FIG. 1A, a platform 104 supports a derrick 102 having a pulley 106 for raising and lowering the cleanout tool 150 that is lowered through the wellhead by a wireline or slickline cable 110. The cable 110 is deployed from a spool 108 of cable 110 that may be coupled to a control system (not shown). The cable 110 may be routed over a pulley 106 and into the wellbore 112. Once deployed into the wellbore 112, a well operator may directly or indirectly operate the cleanout tool 150 to remove scaling from the interior surface of the casing 116. FIG. 1B is analogous to FIG. 1A and shows the cleanout tool 150 deployed from a sea-based platform 132. Like components shown in FIG. 1B have the same reference numerals as used with regard to FIG. 1A and may not be further discussed. In FIG. 1B, the wellbore 112 extends beneath a blowout preventer 136 and seabed 140 into the subterranean formation 120.

Figure 2:
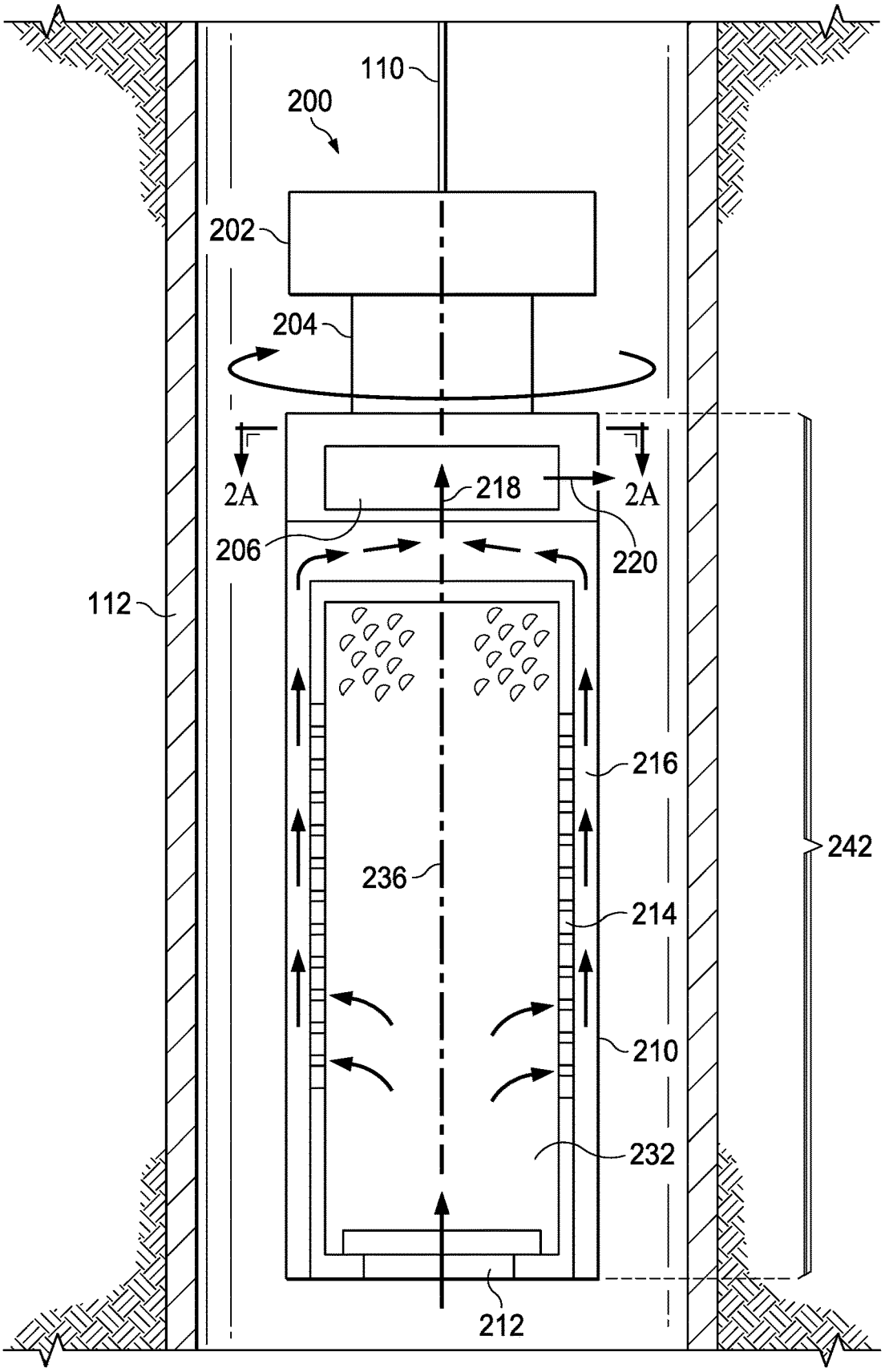
FIG. 2 is a schematic, cross-section view of a cleanout tool having a rotatable housing and a filter disposed therein.

FIG. 2 shows an embodiment of a cleanout tool that is analogous to the cleanout tool 150 of FIGS. 1A and 1B, deployed within a wellbore 112 by cable 110. The tool includes a tool housing 200 having a non-rotating portion 202, which may include a control unit that communicates with a control system at the surface and provides power and telemetry capabilities to the cleanout tool. The non-rotating portion 202 may be coupled to a rotatable joint 204, which may include, for example, a swivel joint and a slip ring for providing electrical and control signals to, and receiving signals from, the lower portion of the tool.

Figure 2A:
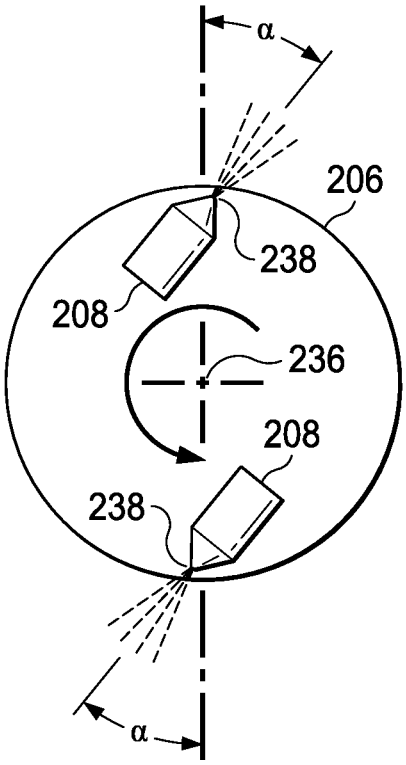
FIG. 2A is a section view of a plurality of nozzles disposed within the cleanout tool of FIG. 2, taken along the section line 2A-2A.

The rotatable joint 204 couples the non-rotating portion 202 of the tool housing 200 with a lower rotating portion 242, which may also be referred to as a rotatable housing. The lower rotating portion 242 may include a motor and pump unit 206, which includes a motor, pump, and one or more nozzles 208, as shown in FIG. 2A. In some embodiments, lower rotating portion 242 includes a generally cylindrical housing operable to rotate about a longitudinal axis 236 of the tool housing 200. The lower rotating portion 242 may also include a filter housing 210 for housing a filter 214. In some embodiments, the filter 214 of the tool is a canister filter having a generally cylindrical body forming a cylindrical cavity 232, and a plurality of apertures disposed about the circumference of the cylindrical body. In other embodiments, the filter 214 is a filter stack.

The filter housing 210 includes a fluid inlet 212 for receiving fluid from the wellbore 112. The fluid inlet 212 is fluidly coupled to a filter cavity 232. The filter 214 includes a filter media that separates the filter cavity from a filter annulus 216 that is bounded by the external surface of the filter 214 and the filter housing 210. The filter 214 may include a plurality of apertures, or a porous surface that separates the filter cavity 232 from the filter annulus 216 and prevents particulates from flowing from the filter cavity 232 through the filter 214 to the annulus 216.

In some embodiments, the annulus 216 forms a portion of a fluid flow path that is fluidly coupled to a pump inlet 218 and pump outlet 220. In such embodiments, the pump is operable to draw fluid from the wellbore 112 through the fluid inlet 212 into the filter cavity 232, across the filter 214, into the filter annulus 216, into the pump inlet 218, and out of the pump outlet 220 through nozzles 208 that are fluidly coupled to the pump outlet 220.

In some embodiments, each nozzle 208 of the downhole cleanout tool has a nozzle outlet 238 that is oriented at an angle ($\alpha$) from a radial axis 240 extending from the longitudinal axis 236 of the rotatable housing to a location where the nozzle outlet intersects the periphery of the rotatable housing. This orientation allows for spray from the nozzle to induce a rotational force on the lower rotating portion 242 to induce rotation so that as the housing rotates, nozzle spray impinges about the full internal circumference of a cross-section of a wellbore 112 in which the nozzle 208 is placed.

Figure 3:
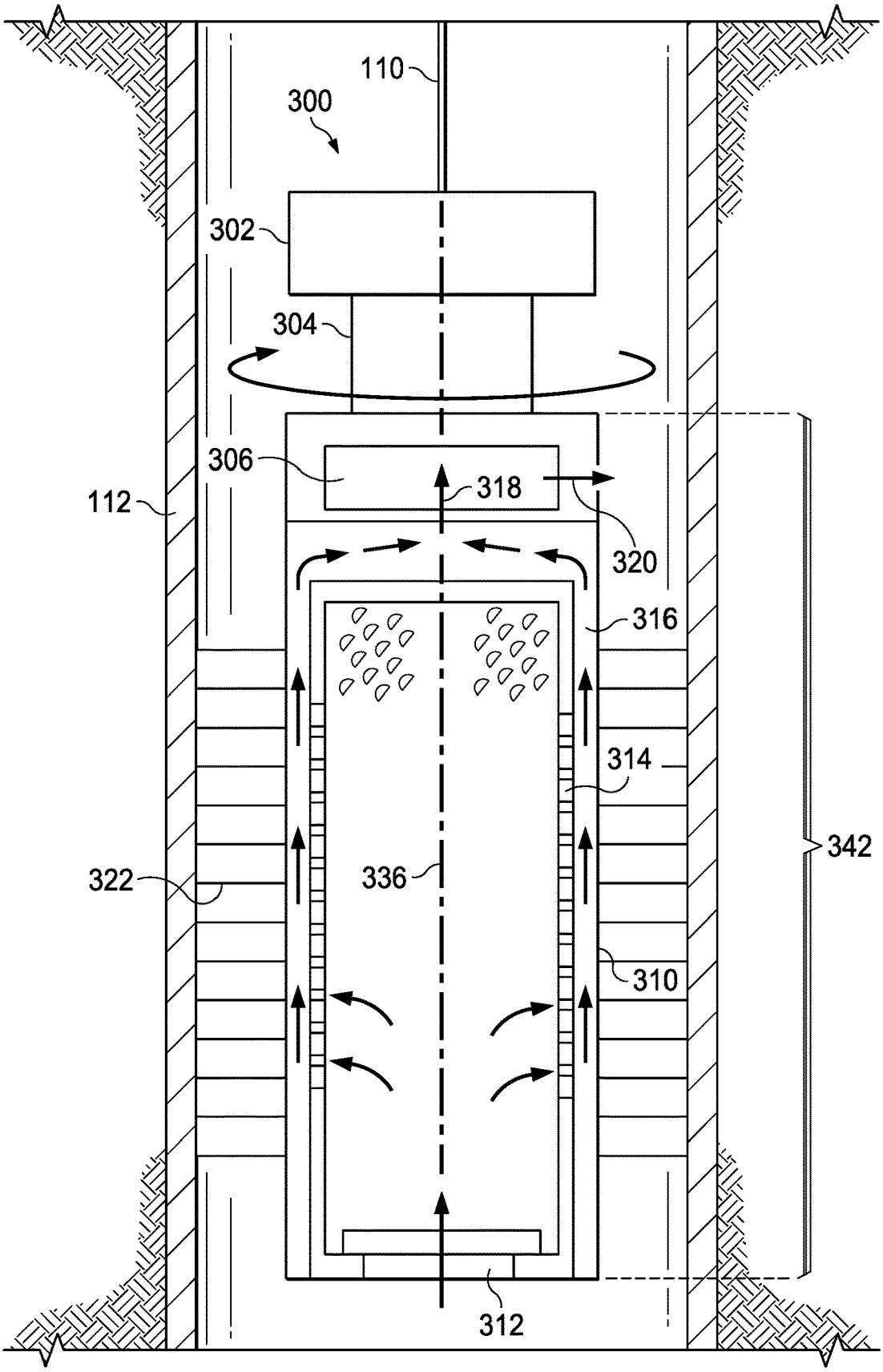
FIG. 3 is a schematic, cross-section view of an alternative embodiment of a cleanout tool, analogous to the cleanout tool pictured in FIG. 2.
Figure 4:
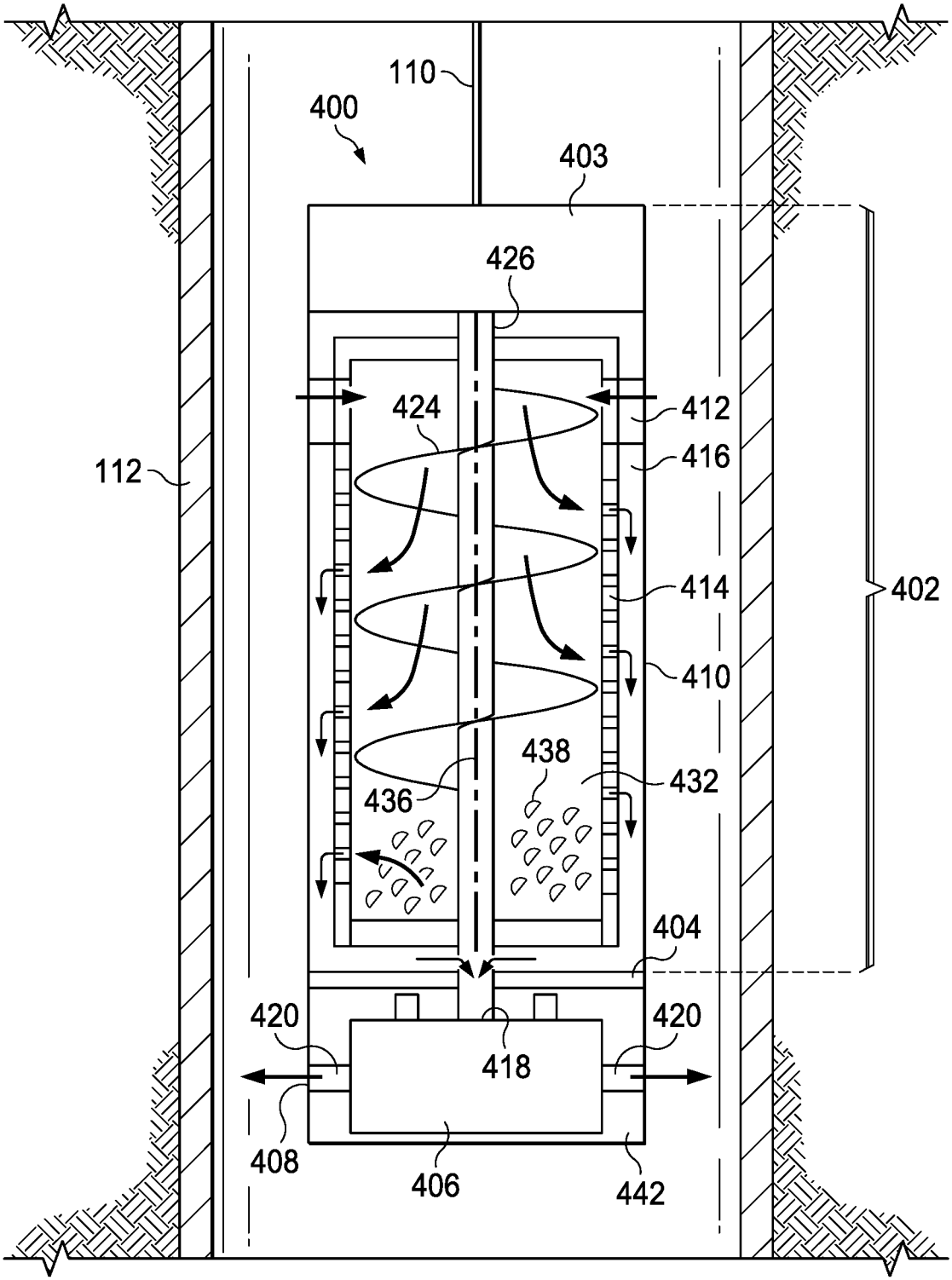
FIG. 4 is a schematic, cross-section view of another alternative embodiment of a cleanout tool, analogous to the cleanout tool pictured in FIG. 2.

FIGS. 3 and 4 show alternative embodiments of cleaning tools that include many components that are similar to those of FIG. 2. In the embodiment of FIG. 3, the tool again includes a tool housing 300 having a non-rotating portion 302, which may include a control unit that provides power and telemetry capabilities to the tool. The non-rotating portion 302 may be coupled to a rotatable joint 304, which may include a slip ring for providing electrical and control signals to, and receiving signals from, the lower portion of the tool housing 300. The rotatable joint 304 couples the non-rotating portion 302 of the tool housing 300 with a lower rotating portion 342, or rotatable housing. The lower rotating portion 342 may include a motor and pump unit 306, which includes a motor, pump, and one or more nozzles (analogous to nozzles 208 shown in FIG. 2A). In some embodiments, lower rotating portion 342 includes a generally cylindrical housing operable to rotate about a longitudinal axis 336 of the tool housing 300. The lower rotating portion 342 may also include a filter housing 310 for housing a filter 314.

In some embodiments, each nozzle of the downhole cleanout tool has a nozzle outlet that is oriented at an angle ($\alpha$) from a radial axis extending from the longitudinal axis of the rotatable housing to a location where the nozzle outlet intersects the periphery of the rotatable housing (analogous to the orientation of FIG. 2A). This orientation allows for spray from the nozzle to induce a rotational force on the lower rotating portion 342 so that as the housing rotates, nozzle spray impinges about the full internal circumference of a cross-section of a wellbore 112 in which the nozzle is placed. In the embodiment of FIG. 3, scrubbers 322, which may be metallic scrubbers, brushes, or bristles, are affixed to the external surface of the rotatable housing and extend to engage the internal wall of the wellbore 112. As noted above, in some embodiments, rotation of the rotating portion 342 may be assisted or independently driven by a motor included in the tool (in, for example, the motor and pump unit 306).

In the embodiment of FIG. 4 a cleanout tool that is analogous to the cleanout tool 150 of FIGS. 1A and 1B is again deployed within a wellbore 112 by cable 110. The tool has a tool housing 400 that includes a non-rotating portion 402 coupled a lower rotating portion 442. The nonrotating portion includes a control unit 403 that provides power and telemetry capabilities to the tool. The non-rotating portion 402 may be coupled to a rotatable joint 404 that is also coupled to the lower rotating portion 442. In the embodiment of FIG. 4, the nonrotating portion 402 also includes a filter 414 positioned above or uphole from lower rotating portion 442.

The lower rotating portion 442 again includes a motor and pump unit 406, which includes a motor, pump, and one or more nozzles (as shown in FIG. 2A). The lower rotating portion 442 includes a generally cylindrical housing operable to rotate about a longitudinal axis 436 of the tool housing 400.

Here, the filter 414 of the tool is a canister filter having a generally cylindrical body forming a cylindrical cavity 432, and a plurality of apertures disposed about the circumference of the cylindrical body. A spindle 426 and auger 424 are positioned within the cylindrical cavity 432 and rotatably coupled to the lower rotating portion 442 such that rotation of the lower rotating portion 442 results in corresponding rotation of the auger 424 and spindle 426. In some embodiments, the spindle 426 conveys wiring from the control unit positioned in the non-rotating portion 402 to the motor and pump unit 406.

The filter housing 410 again includes a fluid inlet 412 for receiving fluid from the wellbore 112. The fluid inlet 412 is fluidly coupled to a filter cavity 432. The filter 414 includes a filter media that separates the filter cavity from a filter annulus 416 that is bounded by the external surface of the filter 414 and the filter housing 410. The filter 414 may include a plurality of apertures, or a porous surface that separates the filter cavity 432 from the filter annulus 416 and prevents particulates from flowing from the filter cavity 432 through the filter 414 to the annulus 416.

The annulus 416 forms a portion of a fluid flow path that is fluidly coupled to a pump inlet 418 and pump outlet 420. In such embodiments, the pump is operable to draw fluid from the wellbore 112 through the fluid inlet 412 into the filter cavity 432, across the filter 414, into the filter annulus 416, into the pump inlet 418, and out of the pump outlet 420 through nozzles 408 that are fluidly coupled to the pump outlet 420.

As described above with respect to the embodiments of FIGS. 2 and 3, each nozzle of the downhole cleanout tool has a nozzle outlet that is oriented at an angle ($\alpha$) from a radial axis extending from the longitudinal axis 436 of the rotatable housing to a location where the nozzle outlet intersects the periphery of the rotatable housing. This orientation allows for spray from the nozzle to induce a rotational force on the lower rotating portion 442 to induce rotation so that as the housing rotates, nozzle spray impinges about the full internal circumference of a cross-section of a wellbore 112 in which the nozzle is placed. In the embodiment of FIG. 4, the coupling between the lower rotating portion 442 and spindle 426 and auger 424 allows for spray from the nozzles to also result in rotation of the auger 424. The auger 424 is operable, when rotated, to collect and compress particulate 438 filtered from fluid in the cylindrical filter cavity 432 at a downhole end of the filter cavity 432.

In operation, the embodiments of wellbore cleanout tools described with regard to FIGS. 2-4 function to clean it wellbore according to the principles described below. Referring again to FIGS. 2 and 2A, the cleanout tool is actuated automatically or via a control signal received over cable 110. The control signal results and actuations signal to the motor and pump unit 206 to initiate the pump. Initiation of the pump results in wellbore fluid being drawn into the tool housing 200 through the fluid inlet 212 and ultimately into the pump inlet 218. Fluid drawn in by the pump is expelled from the pump outlet 220 and forced through the nozzles 208. The nozzles 208 include nozzle outlets that are directed at the wellbore wall at an angle ($\alpha$) from the radial. The angle ($\alpha$) may be forty-five degrees, and may range from thirty to sixty degrees. Other angles may also be suitable. The fluid stream results in a tangential force that causes rotation of the rotating portion 242 of the tool housing 200. As the rotating portion 242 of the tool housing 200 rotates, fluid from the nozzles contacts the full circumference (360°) of the well surface.

The pump flow rate and nozzles 208 are selected such that the nozzle spray is operable to clean the wall of the wellbore 112 by directing a high velocity stream or jet of fluid against the wellbore wall to remove scaling and other debris. In an embodiment, the flow rate and nozzles are configured to direct turbulent flow onto the wellbore wall. When the pressurized fluid impinges on the wall of the wellbore 112, kinetic energy of the fluid knocks debris and other build-up off of the wellbore wall. The number of nozzles may be selected based on the well fluid composition and desired rotational speed of the rotating portion 242. Debris may be collected by the tool as it continues to operate.

The pump flow rate and nozzles 208 are selected such that the nozzle spray is operable to clean the wall of the wellbore 112 by directing a high velocity stream or jet of fluid against the wellbore wall to remove scaling and other debris. Debris may be collected by the tool as it continues to operate. Fluid proximate to the tool housing 200 is drawn into the fluid inlet 212 where it is filtered to remove debris. The filter debris is collected within the cavity 232 as fluid is drawn from the fluid inlet 212 through the filter 214 and into the filter annulus 216. The filtered fluid is then circulated through the pump and emitted at a high velocity through the nozzles 208 to continue to remove scaling and debris from the wellbore wall. This fluid circulation over a period of time leads to a cleaner well and the debris that is accumulated in the filter 214 can be transported back to the surface for disposal.

The embodiment of FIG. 3 functions similarly to that of FIG. 2. Actuation of the pump unit 306 results in fluid flow through the nozzles positioned in the rotating portion 342. Nozzles in the rotating portion 342 operate to spray fluid onto the wellbore wall to remove scaling and other debris. The cleaning effected by the nozzles is, however, augmented by scrubbers 322 that contact the wellbore wall when the rotating portion 342 is rotated, thereby mechanically removing scale and other debris from the wellbore wall so that it may be collected by the filter 314.

Operation of the embodiment of FIG. 4 is similar, though certain components of the cleaning tool are oriented differently. Here, the filter 414 is positioned within the non-rotating portion 402 of the tool housing 400. The motor and pump unit 406 and associated nozzles, however, are positioned within the rotating portion 442, which is coupled to the filter housing 410. The rotating portion 442 is further coupled to a spindle 426 and auger 424 that are free to rotate within the cylindrical cavity 432. Actuation of the pump unit 406 and nozzles again results in removal of scaling and other debris from the wellbore. The debris may be collected in the filter and compressed toward an end of the filter 414 to allow prolonged operation of the cleaning tool. In some embodiments, the spindle 426 and auger 424 are coupled to the motor and pump unit 406 and are directly driven by the motor and pump unit 406. In other embodiments, the spindle 426 and auger 424 may be driven by the fluid forces generated by fluid being pulled through the filter by the motor and pump unit 406. In some embodiments, the filter 414 rotates and the spindle 426 and auger 424 remain stationary or rotate in an opposite direction. This relative rotation between the filter 414 and the spindle 426 and auger 424 helps to move the debris further into the cylindrical cavity 432 by the auger 424.

The auger 424 may have a softer material tip (e.g., a non-metal tip affixed to a metallic auger 424) around the area touching the filter to effectively wipe the interior surface of the filter 414 without causing damage. In this manner, rotation of auger 424 with respect to filter 414 helps to clean or wipe the interior surface of the filter 414 to diminish the occurrence damage and obstructions.

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. The scope of the claims is intended to broadly cover the disclosed embodiments and any such modification.

As used herein, the singular forms "a", "an" and "the" are intended to include the plural forms as well, unless the context clearly indicates otherwise. It will be further understood that the terms "comprise" and/or "comprising," when used in this specification and/or the claims, specify the presence of stated features, steps, operations, elements, and/or components, but do not preclude the presence or addition of one or more other features, steps, operations, elements, components, and/or groups thereof. In addition, the steps and components described in the above embodiments and figures are merely illustrative and do not imply that any particular step or component is a requirement of a claimed embodiment.

The present disclosure may also be understood as including at least the following clauses:

Clause 1: A downhole cleanout tool comprising: a tool housing having a fluid inlet and a fluid outlet; a filter disposed between the fluid inlet and the fluid outlet; a pump having a pump inlet and a pump outlet, the pump being fluidly coupled to at least the fluid inlet to motivate fluid across the filter; and a rotatable housing having at least one nozzle disposed therein, the nozzle being fluidly coupled to the pump outlet.

Clause 2: The downhole cleanout tool of clause 1, wherein the rotatable housing comprises a generally cylindrical housing operable to rotate about a longitudinal axis of the rotatable housing, wherein the filter and pump are disposed within the rotatable housing, and wherein the rotatable housing is coupled to a power source and a supporting cable via a rotatable joint.

Clause 3: The downhole cleanout tool of clause 2, wherein each nozzle comprises a nozzle outlet oriented at an angle (α) from a radial axis extending from the longitudinal axis of the rotatable housing to a location where the nozzle outlet intersects the periphery of the rotatable housing.

Clause 4: The downhole cleanout tool of clause 2 or 3, further comprising: a cable, wherein the rotatable joint comprises a slip ring and wherein, the rotatable housing is configured to rotate about the longitudinal axis upon circulation of fluid through the nozzle.

Clause 5: The downhole cleanout tool of any of clauses 1-4, wherein the filter is a canister filter having: a filter inlet fluidly coupled to the fluid inlet, a generally cylindrical body forming a cylindrical cavity, and a plurality of apertures disposed about the circumference of the cylindrical body, the apertures being fluidly coupled to an annulus between an external surface of the canister filter and an internal surface of the rotatable housing, wherein the annulus is fluidly coupled to the pump inlet.

Clause 6: The downhole cleanout tool of clause 5, wherein the rotatable housing is coupled to a downhole end of the filter, and wherein the rotatable housing is coupled to a spindle extending from the rotatable housing through the cylindrical cavity of the filter, the spindle comprising an auger.

Clause 7: The downhole cleanout tool of clause 6, wherein the spindle and auger are operable to rotate relative to the generally cylindrical body of the filter when fluid is circulated through the nozzle.

Clause 8: The downhole cleanout tool of any of clauses 1-7, wherein the rotatable housing comprises a plurality of brushes extending from an external surface of the rotatable housing.

Clause 9: A method of cleaning a wellbore comprising: deploying cleanout tool into a well, the cleanout tool comprising a tool housing having a fluid inlet and a fluid outlet, a filter disposed between the fluid inlet and the fluid outlet, a pump having a pump inlet and a pump outlet, the pump being fluidly coupled to at least the fluid inlet, and a rotatable housing having at least one nozzle disposed therein, the nozzle being fluidly coupled to the pump outlet; and operating the pump to motivate fluid across the filter and through the nozzle, wherein operating the pump causes rotation of the rotatable housing and application of a scrubbing stream of fluid from the nozzle to an inner circumferential surface of the wellbore.

Clause 10: The method of clause 9, wherein operating the pump comprises delivering power and an actuation signal to the pump via a supporting cable and a rotatable joint, and wherein the filter and pump are disposed within the rotatable housing, the rotatable housing being coupled to the supporting cable by the rotatable joint.

Clause 11: The method of clause 9 or 10, further comprising orienting each nozzle at an angle (α) from a radial axis extending from a longitudinal axis of the rotatable housing to a location where the centerline of a nozzle outlet intersects the periphery of the rotatable housing.

Clause 12: The method of clause 11, further comprising dynamically changing the angle (α) upon in response to detecting scaling on the wellbore.

Clause 13: The method of any of clauses 9-12, wherein operating the pump comprises motivating fluid through a filter inlet fluidly coupled to the fluid inlet and through a plurality of apertures disposed about a circumference of filter.

Clause 14: The method of clause 13, further comprising rotating an auger disposed on a spindle positioned within a cylindrical cavity of the filter in response to rotation of the rotatable housing.

Clause 15: The method of any of clauses 9-14, further comprising scrubbing the wellbore with a plurality of brushes extending from an external surface of the rotatable housing.

Clause 16: A wellbore cleaning system comprising: a cable; and a cleanout tool coupled to the cable, the cleanout tool having a control unit coupled to the cable, a rotatable joint, a pump, a filter, a rotatable housing, and a plurality of nozzles having nozzle outlets spaced equidistantly a periphery of the cleanout tool, wherein the plurality of nozzles are positioned within the rotatable housing.

Clause 17: The system of clause 16, wherein: the rotatable housing comprises a generally cylindrical housing operable to rotate about a longitudinal axis of the rotatable housing, the filter and pump are disposed within the rotatable housing, and the rotatable housing is electrically coupled to the control unit through the rotatable joint.

Clause 18: The system of clause 16 or 17, wherein each nozzle comprises a nozzle outlet oriented at an angle (α) from a radial axis extending from a longitudinal axis of the rotatable housing to a location where the nozzle outlet intersects the periphery of the rotatable housing.

Clause 19: The system of clause 18, wherein the rotatable housing comprises a plurality of brushes extending from an external surface of the rotatable housing.

Clause 20: The system of any of clauses 16-19, further comprising an auger and spindle positioned within a cylindrical cavity of the filter and rotationally coupled to the rotatable housing, wherein the auger and spindle are operable to rotate within the filter upon rotation of the rotatable housing.

The invention claimed is:

1. A downhole cleanout tool comprising:

a tool housing having a fluid inlet and a fluid outlet;

a filter disposed between the fluid inlet and the fluid outlet;

a pump having a pump inlet and a pump outlet, the pump being fluidly coupled to at least the fluid inlet to motivate fluid across the filter; and a rotatable housing having at least one nozzle disposed therein, the nozzle being fluidly coupled to the pump outlet, wherein the pump is disposed within the rotatable housing.

2. The downhole cleanout tool of claim 1, wherein the rotatable housing comprises a generally cylindrical housing operable to rotate about a longitudinal axis of the rotatable housing, wherein the filter is disposed within the rotatable housing, wherein the rotatable housing is coupled to a power source and a supporting cable via a rotatable joint.

3. The downhole cleanout tool of claim 2, wherein each nozzle comprises a nozzle outlet oriented at an angle (α) from a radial axis extending from the longitudinal axis of the rotatable housing to a location where the nozzle outlet intersects a periphery of the rotatable housing.

4. The downhole cleanout tool of claim 2, further comprising: a cable, wherein the rotatable joint comprises a slip ring and wherein, the rotatable housing is configured to rotate about the longitudinal axis upon circulation of fluid through the nozzle.

5. The downhole cleanout tool of claim 1, wherein the filter is a canister filter having:

a filter inlet fluidly coupled to the fluid inlet, a generally cylindrical body forming a cylindrical cavity, and a plurality of apertures disposed about the circumference of the cylindrical body, the apertures being fluidly coupled to an annulus between an external surface of the canister filter and an internal surface of the rotatable housing, wherein the annulus is fluidly coupled to the pump inlet.

6. The downhole cleanout tool of claim 5, wherein the rotatable housing is coupled to a downhole end of the filter, and wherein the rotatable housing is coupled to a spindle extending from the rotatable housing through the cylindrical cavity of the filter, the spindle comprising an auger.

7. The downhole cleanout tool of claim 6, wherein the spindle and auger are operable to rotate relative to the generally cylindrical body of the filter when fluid is circulated through the nozzle.

8. The downhole cleanout tool of claim 1, wherein the rotatable housing comprises a plurality of brushes extending from an external surface of the rotatable housing.

9. A method of cleaning a wellbore comprising:

deploying cleanout tool into a well, the cleanout tool comprising a tool housing having a fluid inlet and a fluid outlet, a filter disposed between the fluid inlet and the fluid outlet, a pump having a pump inlet and a pump outlet, the pump being fluidly coupled to at least the fluid inlet, and a rotatable housing having at least one nozzle disposed therein, the nozzle being fluidly coupled to the pump outlet; and operating the pump to motivate fluid across the filter and through the nozzle, wherein the pump is disposed within the rotatable housing, and wherein operating the pump causes rotation of the rotatable housing and application of a scrubbing stream of fluid from the nozzle to an inner circumferential surface of the wellbore.

10. The method of claim 9, wherein operating the pump comprises delivering power and an actuation signal to the pump via a supporting cable and a rotatable joint, and wherein the filter is disposed within the rotatable housing, the rotatable housing being coupled to the supporting cable by the rotatable joint.

11. The method of claim 9, further comprising orienting each nozzle at an angle ($\alpha$) from a radial axis extending from a longitudinal axis of the rotatable housing to a location where the centerline of a nozzle outlet intersects a periphery of the rotatable housing.

12. The method of claim 11, further comprising dynamically changing the angle ($\alpha$) upon in response to detecting scaling on the wellbore.

13. The method of claim 9, wherein operating the pump comprises motivating fluid through a filter inlet fluidly coupled to the fluid inlet and through a plurality of apertures disposed about a circumference of filter.

14. The method of claim 13, further comprising rotating an auger disposed on a spindle positioned within a cylindrical cavity of the filter in response to rotation of the rotatable housing.

15. The method of claim 9, further comprising scrubbing the wellbore with a plurality of brushes extending from an external surface of the rotatable housing.

16. A wellbore cleaning system comprising:

a cable; and a cleanout tool coupled to the cable, the cleanout tool having a control unit coupled to the cable, a rotatable joint, a pump, a filter, a rotatable housing, and a plurality of nozzles having nozzle outlets spaced equidistantly a periphery of the cleanout tool, wherein the plurality of nozzles are positioned within the rotatable housing, and wherein the pump is disposed within the rotatable housing.

17. The system of claim 16, wherein:

the rotatable housing comprises a generally cylindrical housing operable to rotate about a longitudinal axis of the rotatable housing, the filter is disposed within the rotatable housing, and the rotatable housing is electrically coupled to the control unit through the rotatable joint.

18. The system of claim 16, wherein each nozzle comprises a nozzle outlet oriented at an angle ($\alpha$) from a radial axis extending from a longitudinal axis of the rotatable housing to a location where the nozzle outlet intersects a periphery of the rotatable housing.

19. The system of claim 16, wherein the rotatable housing comprises a plurality of brushes extending from an external surface of the rotatable housing.

20. The system of claim 16, further comprising an auger and spindle positioned within a cylindrical cavity of the filter and rotationally coupled to the rotatable housing, wherein the auger and spindle are operable to rotate within the filter upon rotation of the rotatable housing.

* * * * *